US011260492B2

(12) United States Patent
Weber

(10) Patent No.: US 11,260,492 B2
(45) Date of Patent: Mar. 1, 2022

(54) APPARATUS FOR MACHINING A WORKPIECE

(71) Applicant: Georg Weber, Kronach (DE)

(72) Inventor: Georg Weber, Kronach (DE)

( * ) Notice: Subject to any disclaimer, the term of this patent is extended or adjusted under 35 U.S.C. 154(b) by 565 days.

(21) Appl. No.: 15/182,915

(22) Filed: Jun. 15, 2016

(65) Prior Publication Data

US 2016/0375541 A1 Dec. 29, 2016

(30) Foreign Application Priority Data

Jun. 24, 2015 (DE) ..... 10 2015 110 115.7

(51) Int. Cl.
*B24B 21/00* (2006.01)
*B24D 13/06* (2006.01)
(Continued)

(52) U.S. Cl.
CPC ..... *B24B 21/00* (2013.01); *B24B 7/06* (2013.01); *B24B 21/04* (2013.01); *B24B 29/005* (2013.01);
(Continued)

(58) Field of Classification Search
CPC ..... B24B 21/00; B24B 21/006; B24B 21/04; B24B 27/033; B24B 7/06; B24D 99/005; B24D 29/005
See application file for complete search history.

(56) References Cited

U.S. PATENT DOCUMENTS 3,410,032 A 11/1968 Meinerding
4,971,022 A * 11/1990 Scott ..... B27B 17/12 125/21
(Continued)

FOREIGN PATENT DOCUMENTS

EP 1 910 024 B1 4/2008
EP 2 792 450 A1 10/2014
(Continued)

OTHER PUBLICATIONS

"Right-Tighty and Lefty-Loosey." Jul. 28, 2014. OnTheHouse.com. p. 1. <https://www.onthehouse.com/righty-tighty-lefty-loosey/>. (Year: 2014).*

*Primary Examiner* — Joel D Crandall
(74) *Attorney, Agent, or Firm* — McGarry Bair PC

(57) ABSTRACT

An apparatus (10) for machining a workpiece (12) comprises at least two machining elements (14*a*, 14*b*) and a rotating belt (16) for moving the machining elements (14*a*, 14*b*) relative to a workpiece (12) to be machined. The machining elements (14*a*, 14*b*) each comprise a main body (20*a*, 20*b*) and a first connecting element (22*a*, 22*b*) connected to the main body (20*a*, 20*b*), which first connecting element is connectable to a second connecting element (24*a*, 24*b*) complementary to the first connecting element (22*a*, 22*b*) and connected to the belt (16). The first connecting element (22*a*, 22*b*) comprises a rotary body (26*a*, 26*b*). The second connecting element (24*a*, 24*b*) has a connection area (28*a*, 28*b*) for connection with the rotary body (26*a*, 26*b*). When the rotary body (26*a*, 26*b*) is rotated in a first rotary direction (R1) the rotary body (26*a*, 26*b*) is connected to the connection area (28*a*, 28*b*). When the rotary body (26*a*, 26*b*) is rotated in a second rotary direction (R2) opposed to the first rotary direction (R1) the rotary body (26*a*, 26*b*) is separated from the connection area (28*a*, 28*b*). The rotary body (26*a*, 26*b*) is arranged relative to the main body (20*a*, 20*b*) and connected to the latter in such a manner that during machining of the workpiece (12) a resulting force is exerted on the rotary body (26*a*, 26*b*) via the main body (20*a*, 20*b*), which force provides a torque for a rotation of the rotary body (26*a*, 26*b*) in the first rotary direction (R1).

20 Claims, 9 Drawing Sheets

(51) Int. Cl.

| | |
|---|---|
| ***B24B 29/00*** | (2006.01) |
| ***B24D 13/10*** | (2006.01) |
| ***B24B 21/04*** | (2006.01) |
| ***B24B 7/06*** | (2006.01) |
| ***B24D 99/00*** | (2010.01) |

(52) U.S. Cl.
CPC ..... *B24D 13/06* (2013.01); *B24D 13/10* (2013.01); *B24D 99/00* (2013.01)

(56) References Cited

U.S. PATENT DOCUMENTS

| | | | | | |
|---|---|---|---|---|---|
| 5,913,605 | A * | 6/1999 | Jusselin | ..... | E02F 9/28 172/772 |
| 2009/0104859 | A1* | 4/2009 | Weiland | ..... | B24B 21/04 451/296 |
| 2010/0183364 | A1* | 7/2010 | Harif | ..... | B23B 31/4073 403/295 |
| 2012/0295523 | A1* | 11/2012 | Weiland | ..... | B24B 21/08 451/296 |

FOREIGN PATENT DOCUMENTS

| | | | | | |
|---|---|---|---|---|---|
| EP | 2792450 | A1 * | 10/2014 | ..... | B08B 1/002 |
| WO | WO 2004039536 | A1 * | 5/2004 | ..... | B08B 1/02 |
| WO | WO-2009121562 | A1 * | 10/2009 | ..... | B08B 1/008 |

* cited by examiner

APPARATUS FOR MACHINING A WORKPIECE

CROSS REFERENCE TO RELATED APPLICATION

Applicant hereby claims foreign priority benefits under U.S.C. § 119 from German Patent Application No. DE 102015110115.7 filed on Jun. 24, 2015, the content of which is incorporated by reference herein.

TECHNICAL FIELD

The invention relates to an apparatus for machining a workpiece having at least two machining elements and a revolving belt for moving the machining elements relative to a workpiece to be machined.

BACKGROUND

From document EP 1 910 024 B1 an apparatus for machining a strip or plate-shaped metal workpiece is known. The known apparatus comprises at least one revolving conveyor device provided with machining elements. The conveyor device directs the machining elements at least approximately linearly in the region of the workpiece to be machined such that they pass the workpiece at an angle or transverse to the feed direction of the workpiece.

In the known apparatus each machining element is screwed to the V-belt of the conveyor device by means of an attachment screw. This is disadvantageous in that the screw connection can only be released with the aid of a tool. Therefore replacing the machining elements is rather cumbersome.

Based on the known state of the art it is an object of the invention to indicate an apparatus and a machining element for machining a workpiece which allow for a replacement of the machining element in a simple and quick manner as well as for a rotationally fixed attachment of the machining element to the belt.

SUMMARY

This object is solved by an apparatus for machining a workpiece, with at least two machining elements, with a rotating belt for moving the machining elements relative to a workpiece to be machined; wherein the machining elements each comprise a main body and a first connecting element connected to the main body, which first connecting element is connectable to a second connecting element which is complementary to the first connecting element and connected to the belt, wherein the first connecting element comprises a rotary body and the second connecting element comprises a connection area for connection with the rotary body, wherein when the rotary body is rotated in a first rotary direction (R1) a connection of the rotary body with the connection area is established, wherein the rotary body is separated from the connection area when the rotary body is rotated in a second rotary direction (R2) opposed to the first rotary direction (R1), and wherein the rotary body is arranged relative to the main body and connected to the latter in such a manner that during machining of the workpiece a resulting force is exerted on the rotary body via the main body, which provides a torque for a rotation of the rotary body in the first rotary direction (R1), and a machining element, with a main body and a first connecting element connected to the main body which first connecting element is connectable to a second connecting element of the apparatus complementary to the first connecting element, wherein the first connecting element comprises a rotary body which is connectable to a connection area of the second connecting element of the apparatus, wherein when the rotary body is rotated in a first rotary direction (R1) the rotary body is connected to the connection area, wherein when the rotary body is rotated in the second rotary direction (R2) opposed to the first rotary direction (R1) the rotary body is separated from the connection area, and wherein the rotary body is arranged relative to the main body and connected with the latter in such a manner that during a predetermined relative movement for machining a workpiece a resulting force is exerted on the rotary body via the main body which force provides a torque for rotating the rotary body in the first rotary direction (R1).

By means of an apparatus having the features described above a simple and quick replacement of the machining elements, which are also denoted as treating elements or working elements, and at the same time a rotationally fixed attachment of the machining elements to the belt are achieved, as in particular the machining elements each comprise a main body and a first connecting element connected to the main body, which first connecting element is connectable to a second connecting element which is connected to the belt and is complementary to the first connecting element. The first connecting element comprises a rotary body, and the second connecting element has a connection area for connection with the rotary body. Hereby, when the rotary body is rotated in a first rotary direction, a connection of the rotary body with the connection area is established. Further, when the rotary body is rotated in a second rotary direction opposed to the first rotary direction, the rotary body is disconnected from the connection area. The rotary body is arranged relative to the main body and connected to it in such a manner that during machining of the workpiece a resulting force is exerted via the main body onto the rotary body which provides a torque for a rotation of the rotary body in the first rotary direction. Thus the machining elements can be replaced quickly and easily and at the same time they can be connected to the belt in a rotationally fixed manner. Due to the torque the rotary body is prevented from leaving its connected state while the workpiece is being machined.

Preferably the torque remains generally constant during the machining of the workpiece. Thus the connected state of the rotary body can be securely maintained during the machining process.

Preferably the rotary body is rotated in the first rotary direction and in the second rotary direction about a rotary axis wherein the rotary axis is perpendicular to the surface of the belt. Thus the rotary body can be rotated parallel to the surface of the belt in order to connect the rotary body with the connection area or to separate it from the connection area, respectively.

Preferably the rotary body and the main body are formed together as one piece. Hereby an undesired rotation of the main body relative to the rotary body during the machining process can be prevented.

Preferably the rotary body is arranged asymmetrically relative to the longitudinal side of the main body and/or relative to the transverse side of the main body on a bottom side of the main body facing the second connecting element. Hereby the forces acting on the surface of the main body during the machining process, and in particular during a grinding process, result in a resulting force on the rotary body which provides the torque.

Preferably a first distance between the rotary body and a front edge of the main body with respect to the grinding direction is smaller than a second distance between the rotary body and a rear edge of the main body with respect to the grinding direction. Further, a third distance between the rotary body and a front edge of the main body with respect to a feeding direction can be smaller than a fourth distance between the rotary body and a rear edge of the main body with respect to the feeding direction. Thus the rotary body can be provided in a front area of the main body with respect to the grinding and feeding directions.

Preferably the first distance measures between 35 and 45 mm. Further, the second distance measures between 20 and 30 mm. Hereby a suitable value for the resulting force on the rotary body can be pre-adjusted.

Preferably the connection area is formed by a recess in the second connecting element. Thus the connection area can be provided in a relatively simple manner.

Preferably the side wall of the recess is inclined in a direction towards the inside of the recess. Hereby the rotary body can be securely received by the recess.

Preferably the apparatus comprises a transport device for generating a relative movement between the workpiece to be machined and the machining elements. Thus the workpiece can be moved in a feed direction to be machined by means of the machining elements.

Preferably the belt is formed such that the machining elements are moved in the area of the workpiece to be machined in a first translatory direction of movement. Further, the transport device is designed such that the workpiece is moved in a second translatory direction of movement. In this case, an angle between the first translatory direction of movement and the second translatory direction of movement is different than 0° and 180°. Thus the first and second translatory directions of movement can have any orientation relative to each other with the exception of a parallel or antiparallel orientation.

Preferably the angle between the first translatory direction of movement and the second translatory direction of movement is 90°. Thus the first and second translatory directions of movement can be directed perpendicularly towards each other. In particular the first translatory direction of movement corresponds to the grinding direction while the second translatory direction of movement corresponds to the feed direction.

Preferably the second connecting element and the belt are connected with each other in the central area of the belt by means of a screw. Hereby the second connecting element can be attached securely to the belt.

Preferably the second connecting element is supported in a rotationally fixed manner relative to the belt by means of two studs. Preferably the screw and the two studs are arranged in a line perpendicular to the grinding direction. Further the two studs are arranged in a peripheral area of the belt on two opposite sides of the connection area. Hereby contortion of the second connecting element relative to the belt during the machining process can be avoided.

Preferably the machining elements are arranged in such a manner spaced from each other that during a rotation of the rotary body in the first rotary direction or in the second rotary direction, respectively, the main body is freely rotatable about a rotary angle in particular within a rotary angle range from 25° to 120°, for example within a rotary angle range from 35° to 95°. Hereby a sufficient distance between the machining elements can be provided so that each of them can be replaced separately.

Preferably the main body is in a mounted state after connection of the rotary body with the connection area. Further, after separating the rotary body from the connection area the main body is in an unmounted state. Further, the first connecting element and the second connecting element can be connected without screws and are designed such that a change between the mounted state and the unmounted state of the main body is effected manually. Hereby a quick-change system for the single machining elements can be obtained.

Preferably the belt is a V-belt which is turned about two pulleys and guided endlessly. Hereby a secure guiding of the machining elements arranged on the belt can be achieved.

Preferably the machining elements each comprise a grinding tool, a brush tool, or a polishing tool for grinding, brushing, or polishing, respectively, the surface of the workpiece. Thus the machining elements can in particular be intended for a grinding process.

According to a further aspect of the invention a machining element for use in an apparatus as described in the foregoing is provided. The machining element comprises a main body and a first connecting element connected to the main body which first connecting element is connectable to a second connecting element of the apparatus which is complementary to the first connecting element. The first connecting element comprises a rotary body which is connectable to a connection area of the second connecting element of the apparatus. When the rotary body is rotated in a first rotary direction, the rotary body is connected to the connection area. When the rotary body is rotated in a second rotary direction opposed to the first rotary direction, the rotary body is separated from the connection area. The rotary body is arranged relative to the main body and connected to it in such a manner that during a predetermined relative movement for machining a workpiece a resulting force is exerted on the rotary body via the main body which provides s a torque for a rotation of the rotary body in the first rotary direction.

Further features and advantages of the invention can be gathered from the following description which explains the invention by means of embodiments in connection with the attached drawing figures.

DETAILED DESCRIPTION

Figure 1:
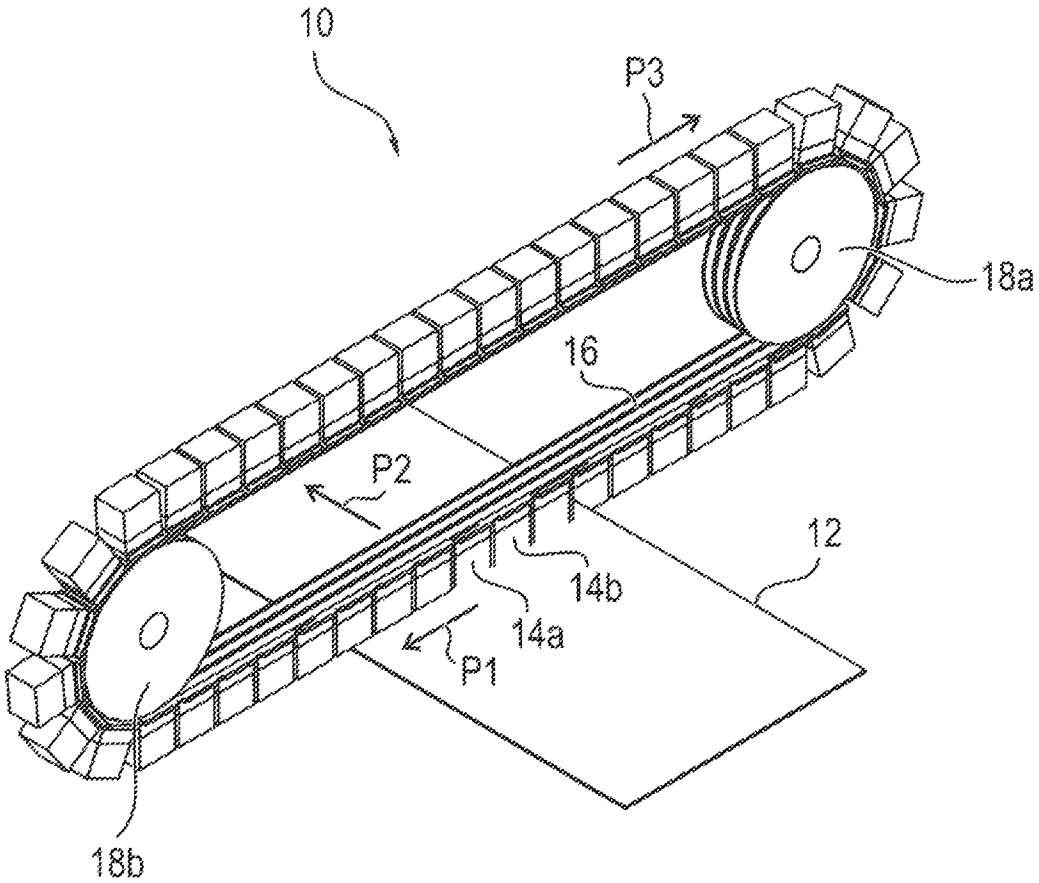
FIG. 1 shows a schematic perspective view of an apparatus for machining a workpiece according to an embodiment of the present invention.

FIG. 1 shows a schematic perspective view of an apparatus 10 for machining a workpiece 12 according to an embodiment of the present invention. As shown in FIG. 1, the apparatus 10 comprises several machining elements 14*a*, 14*b* arranged on a revolving belt 16. The belt 16 is turned about two pulleys 18*a*, 18*b* and guided in an endless manner. The direction of rotation is indicated in FIG. 1 in a schematic manner by arrow P3. The belt 16 may e.g. be a triple V-belt. The machining elements 14*a*, 14*b* are moved relative to the workpiece 12 with the aid of the belt 16. In particular the machining elements 14*a*, 14*b* are moved in the area of the workpiece 12 to be machined in a first direction of movement P1 also denoted as grinding direction. Moreover the apparatus 10 shown in FIG. 1 comprises a transport device (not shown) which serves to move the workpiece 12 in a second direction of movement P2 also denoted as feed direction. The transport device is for example a suitable transport table. By means of the relative movement between the workpiece 12 and the machining elements 14*a*, 14*b* the machining process, e.g. the grinding process for grinding the surface of the workpiece 12 to be machined, can be carried out.

As shown schematically in FIG. 1 the grinding direction P1 corresponds to a direction of a first translatory movement, while the feed direction P2 corresponds to a direction of a second translatory movement. In the embodiment of FIG. 1 the directions of the first and second translatory movements are perpendicular towards each other. In other embodiments the directions of the first and second translatory movements can form any desired angle other than 0° and 180°. Thus the machining elements 14*a*, 14*b* can be moved in a direction at an angle or transverse to the feed direction P2 of the workpiece 12.

Figure 2:
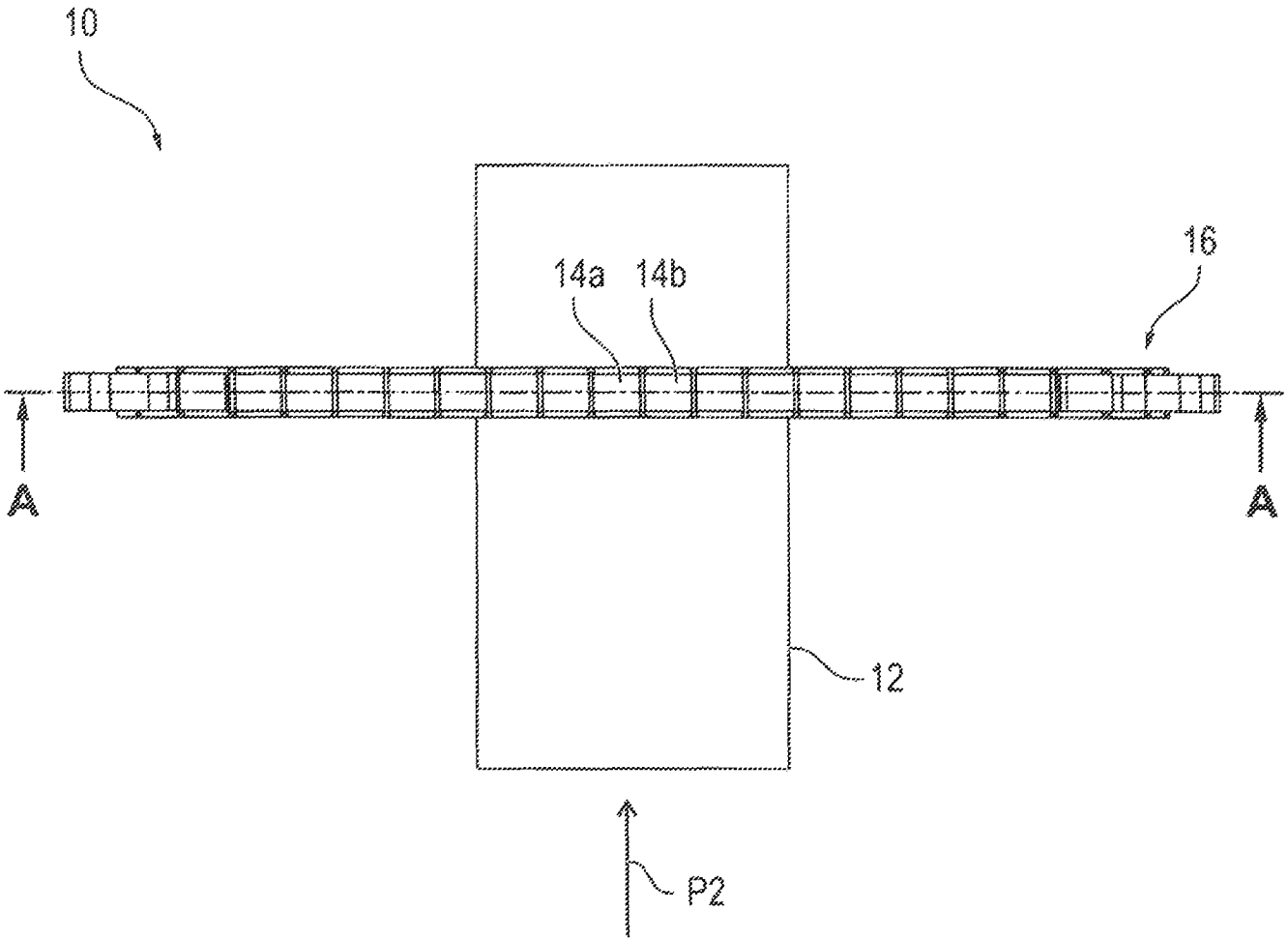
FIG. 2 shows a schematic top view of the apparatus for machining a workpiece according to FIG. 1.

FIG. 2 shows a schematic top view of the apparatus 10 for machining the workpiece 12 according to FIG. 1. In the top view of FIG. 2 the arrangement of the belt 16 with the machining elements 14*a*, 14*b* relative to the workpiece 12 which is moved in the feed direction P2 is clearly visible. Further, in FIG. 2 a cutting line A-A is depicted which extends along the center area of the belt 16 through the machining elements 14*a*, 14*b*. The machining elements 14*a*, 14*b* shown in FIG. 2 are described in greater detail in the following with reference to FIGS. 3*a* and 3*b*.

Figure 3A:
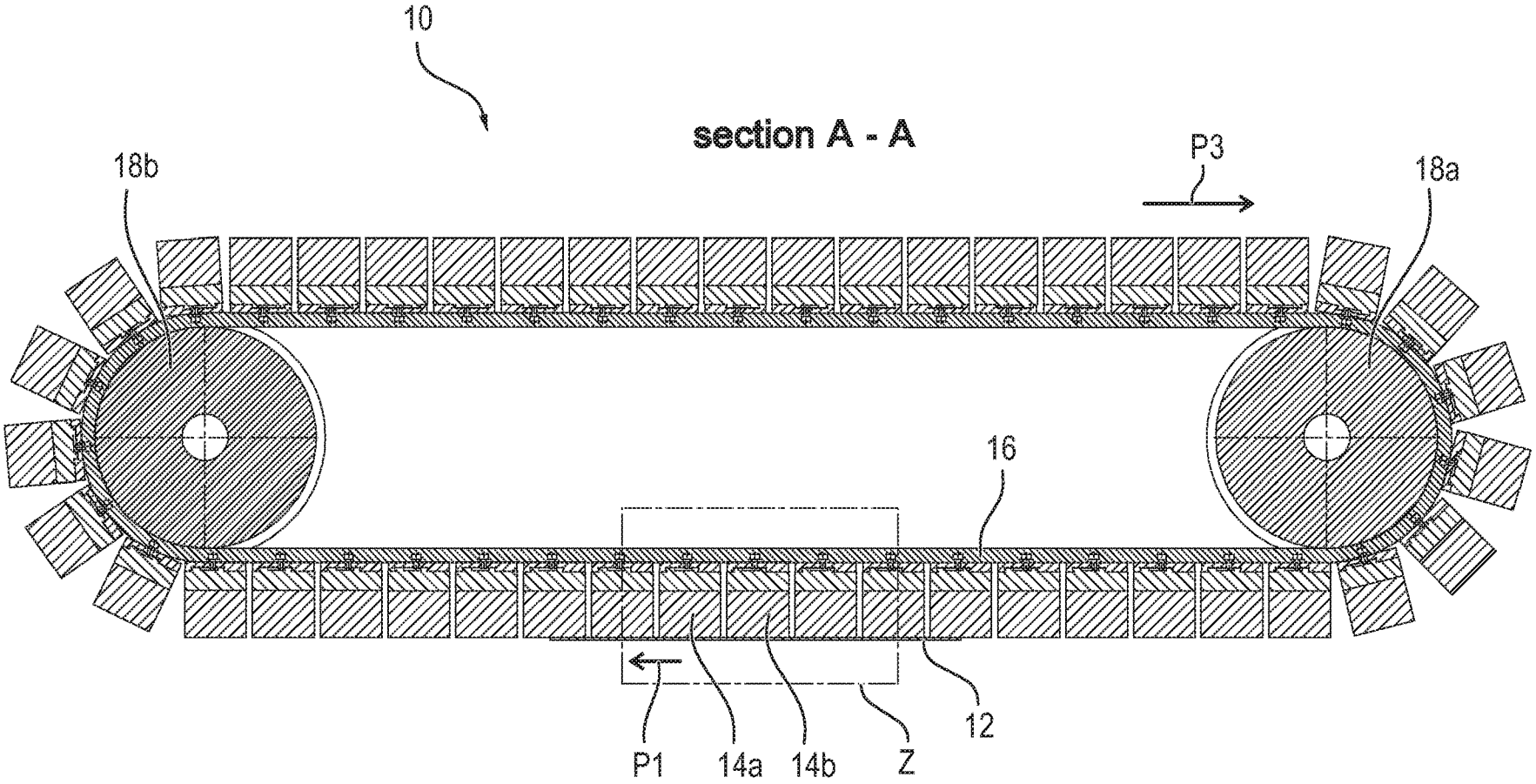
FIG. 3*a* shows a sectional view along cutting line A-A in FIG. 2.

FIG. 3*a* shows a sectional view along the cutting line A-A in FIG. 2. In FIG. 3*a* in particular the internal structure of the belt 16 and the pulleys 18*a*, 18*b* is shown. Further, in FIG. 3*a* the attachment of the machining elements 14*a*, 14*b* to the belt 16 is depicted schematically. The machining elements 14*a*, 14*b* in the area Z shown in FIG. 3*a* are enlarged in the depiction of FIG. 3*b*.

Figure 3B:
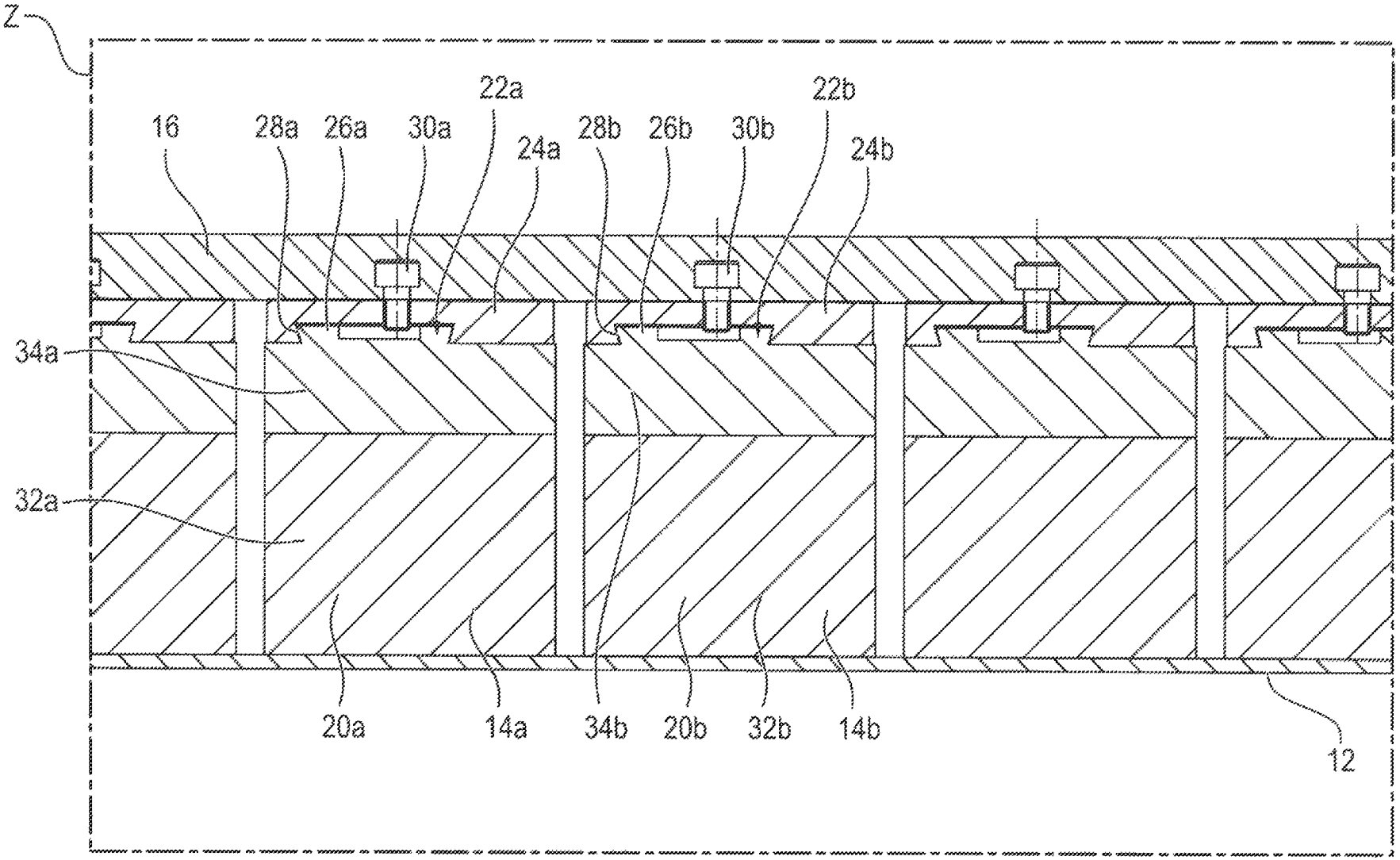
FIG. 3*b* shows an enlarged view of an area of the sectional view depicted in FIG. 3*a;*

FIG. 3*b* shows an enlarged depiction of the area Z of the sectional view according to FIG. 3*a*. As can be seen in FIG. 3*b* the machining elements 14*a*, 14*b* each comprise a main body 20*a*, 20*b* and a first connecting element 22*a*, 22*b* connected to the main body 20*a*, 20*b*. Further according to FIG. 3*b* a second connecting element 24*a*, 24*b* is provided which is connected to the belt 16 via a screw 30*a*, 30*b*. As schematically shown in FIG. 3*b*, the second connecting element 24*a*, 24*b* is complementary to the first connecting element 22*a*, 22*b*. With the aid of the first and second connecting elements 22*a*, 22*b* and 24*a*, 24*b*, respectively, the machining elements 14*a*, 14*b* can be attached to the belt 16.

Moreover, FIG. 3*b* shows that the machining elements 14*a*, 14*b* each comprise a tool, preferably a grinding tool 32*a*, 32*b*, and a retaining element 34*a*, 34*b* for retaining the respective grinding tool 32*a*, 32*b*. The retaining element 34*a*, 34*b* and the grinding tool 32*a*, 32*b* together form the main body 20*a*, 20*b* of the machining elements 14*a*, 14*b*. Moreover, the grinding tool 32*a*, 32*b* is fixedly connected to the respective retaining element 34*a*, 34*b*. The grinding tool 32*a*, 32*b* serves to grind the surface of the workpiece 12 to be machined. Moreover, the grinding tool 32*a*, 32*b* comprises e.g. abrasive paper or abrasive fabrics.

Instead of the grinding tool 32*a*, 32*b* the machining elements 14*a*, 14*b* can also each comprise a brushing tool or a polishing tool. In this case the brushing tool or polishing tool serves to brush or polish, respectively, the surface of the workpiece 12.

According to FIG. 3*b* the first connecting element 22*a*, 22*b* of the machining elements 14*a*, 14*b* comprises a rotary body 26*a*, 26*b*. Moreover, according to FIG. 3*b* the second connecting element 24*a*, 24*b* has a connection area 28*a*, 28*b* for connection with the rotary body 26*a*, 26*b*.

As schematically shown in FIG. 3*b* the distance between two neighboring machining elements 14*a*, 14*b* is big enough so that the main body 20*a*, 20*b* is freely rotatable in a rotary direction parallel to the surface of the belt 16 when the rotary body 26*a*, 26*b* is rotating. In particular the main body is freely rotatable over a rotary angle within a rotary angle range from 25° to 120°, e.g. within an rotary angle range from 35° to 95°. This means that the two neighboring machining elements 14*a*, 14*b* do not touch each other during rotation of their respective rotary bodies 26*a*, 26*b* and that they can therefore be replaced individually.

The following explanations refer to the components which are assigned to one of the machining elements. For the components which are assigned to another machining element these explanations apply in an analogous manner.

Figure 4B:
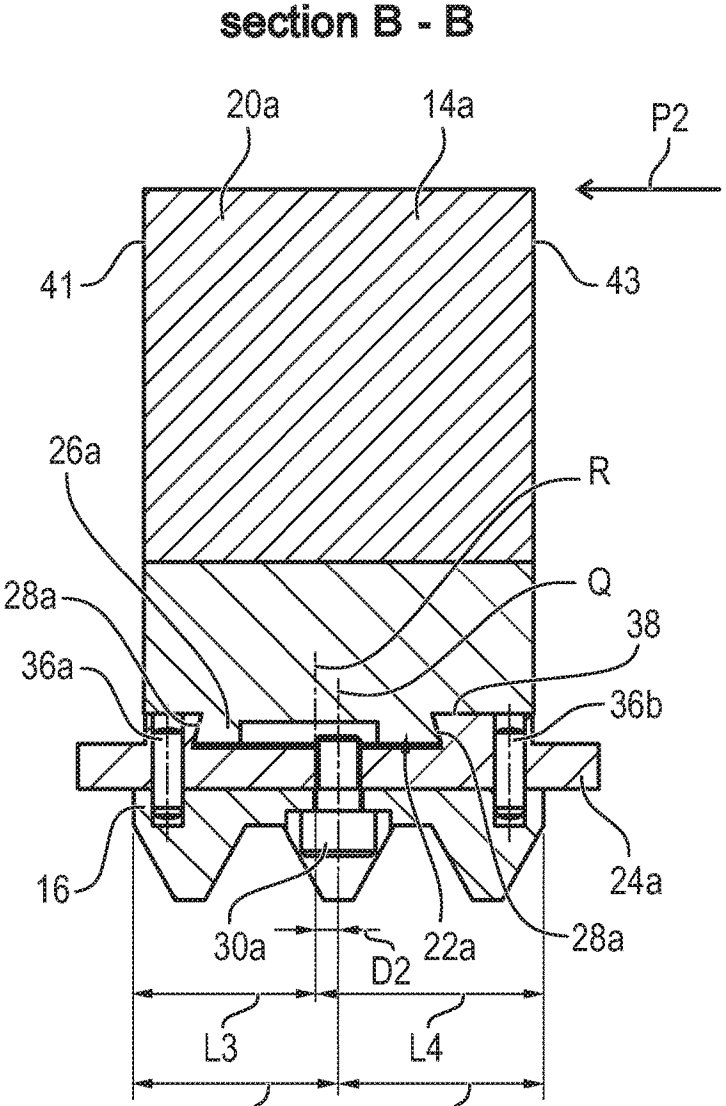
FIG. 4*b* shows a schematic cross sectional view of a machining element of the apparatus shown in FIG. 1 with the main body, the first connecting element, and the rotary body, as well as the second connecting element and the connection area.
Figure 4A:
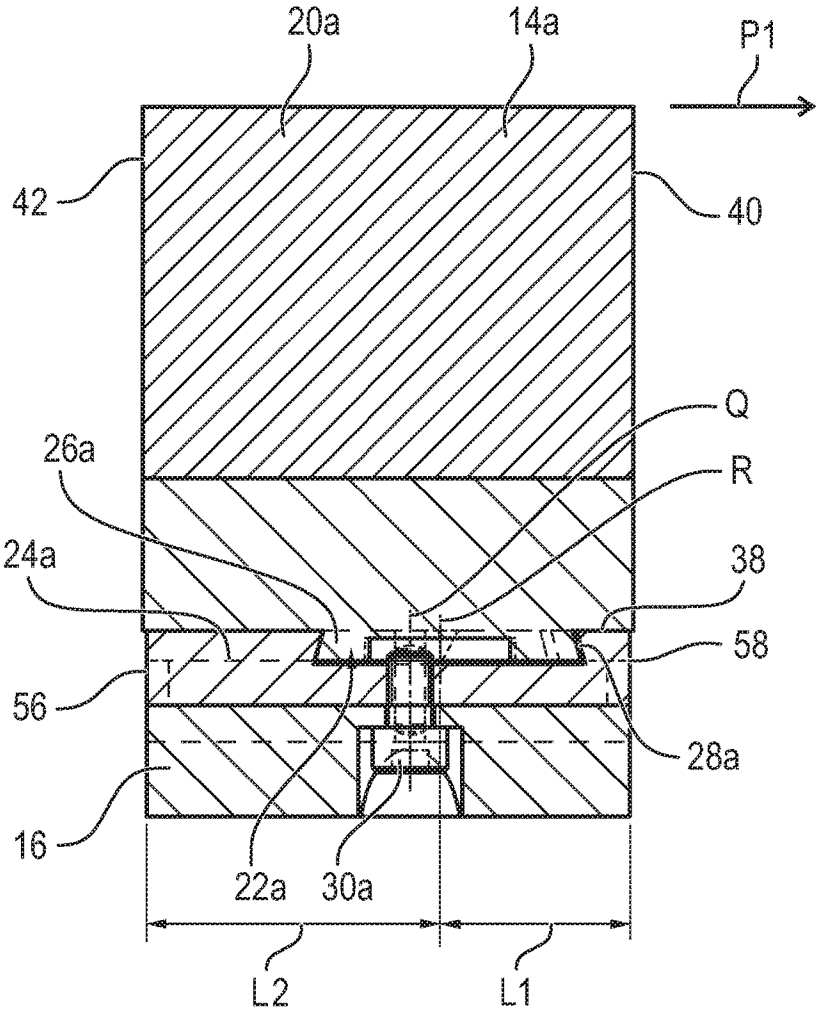
FIG. 4*a* shows a schematic longitudinal sectional view of a machining element of the apparatus shown in FIG. 1 with a main body, a first connecting element and a rotary body, as well as a second connecting element with a connection area.

FIG. 4*a* shows a schematic longitudinal sectional view of a machining element 14*a* of the apparatus 10 shown in FIG. 1 with the main body 20*a*, the connecting element 22*a* and the rotary body 26*a*. Moreover, in FIG. 4*a* the second connecting element 24*a* with the connection area 28*a* and the components 16 and 30*a* are shown. In the longitudinal sectional view of FIG. 4*a* the asymmetric arrangement of the rotary body 26*a* relative to the longitudinal side of the main body 20*a* is clearly shown. The grinding direction P1 is parallel to the longitudinal side of the main body 20*a*.

According to FIG. 4*a* the rotary body 26*a* is arranged asymmetrically relative to the longitudinal side of the main body 20*a* on a bottom side 38 of the main body 20*a* facing the second connecting element 24*a*. Moreover, a first distance L1 between the rotary body 26*a* and a front edge 40 of the main body 20*a* with respect to the grinding direction P1 is smaller than a second distance L2 between the rotary body 26*a* and a rear edge 42 of the main body 20 with respect to the grinding direction P1. In FIG. 4*a* the first and second distances L1 and L2 relate to a rotary axis R of the rotary body 26*a*. As shown in FIG. 4*a*, the screw 30*a* extends through the second connecting element 24*a* into a recess formed by the rotary body 26*a*. This recess is located near the central axis Q of the screw 30*a*.

FIG. 4*b* shows a schematic cross-sectional view of a machining element 14*a* of the apparatus 10 shown in FIG. 1 with the main body 20*a*, the first connecting element 22*a*, and the rotary body 26*a*. Moreover, in FIG. 4*b* the second connecting element 24*a* with the connection area 28*a* as well as the components 16 and 30*a* are shown. The transverse side of the main body 20*a* is perpendicular to the grinding direction P1 shown in FIG. 1. In the cross-sectional view of FIG. 4*b* the structure of the triple V-belt 16 is clearly shown. In the center area of the belt 16 the second connecting element 24*a* and the belt 16 are connected to each other via the screw 30*a*. In particular the center area of the belt 16 is central with regard to the transverse extension of the belt 16. As shown in FIG. 4*b*, the distance S3 between the center axis Q of the screw 30*a* and the front edge 41 of the main body 20*a* with respect to the feed direction P2 equals the distance S4 between the center axis Q of the screw 30*a* and the rear edge 43 of the main body 20*a* relative to the feed direction P2. Moreover, the cross-sectional view of FIG. 4*b* clearly shows the asymmetric arrangement of the rotary body 26*a* relative the transversal side of the main body 20*a*. The feed direction P2 is parallel to the transversal side of the main body 20*a*.

According to FIG. 4*b* the rotary body 26*a* is arranged asymmetrically with respect to the transversal side of the main body 20*a* on a bottom side 38 of the main body 20*a* facing the second connecting element 24*a*. Moreover, a third distance L3 between the rotary body 26*a* and the front edge 41 of the main body 20*a* with respect to the feed direction P2 is smaller than a fourth distance L4 between the rotary body 26*a* and the rear edge 43 of the main body 20*a* with respect to the feed direction P2. In FIG. 4*b* the third and fourth distances L3, L4 are shown relative to the rotary axis R of the rotary body 26*a*, which is displaced relative to the center axis Q of the screw 30*a* by a distance D2 in the feed direction P2.

In the cross-sectional view of FIG. 4*b* two studs 36*a*, 36*b* for mounting the second connecting element 24*a* are clearly shown. As depicted in FIG. 4*b* the two studs 36*a*, 36*b* are arranged on opposite sides of the connection area 28*a* in the peripheral area of the belt 16. The two studs 36*a*, 36*b* each extend through the second connecting element 24*a* into the belt 16 whereby the second connecting element 24*a* is held in a rotationally fixed manner with regard to the belt 16.

As shown in FIGS. 4*a* and 4*b*, the screw 30*a* and the two studs 36*a*, 36*b* are arranged in a line perpendicular to the grinding direction P1. In particular, the screw 30*a* and the two studs 36*a*, 36*b* lie in the common section plane shown in FIG. 4*b*.

Figure 5:
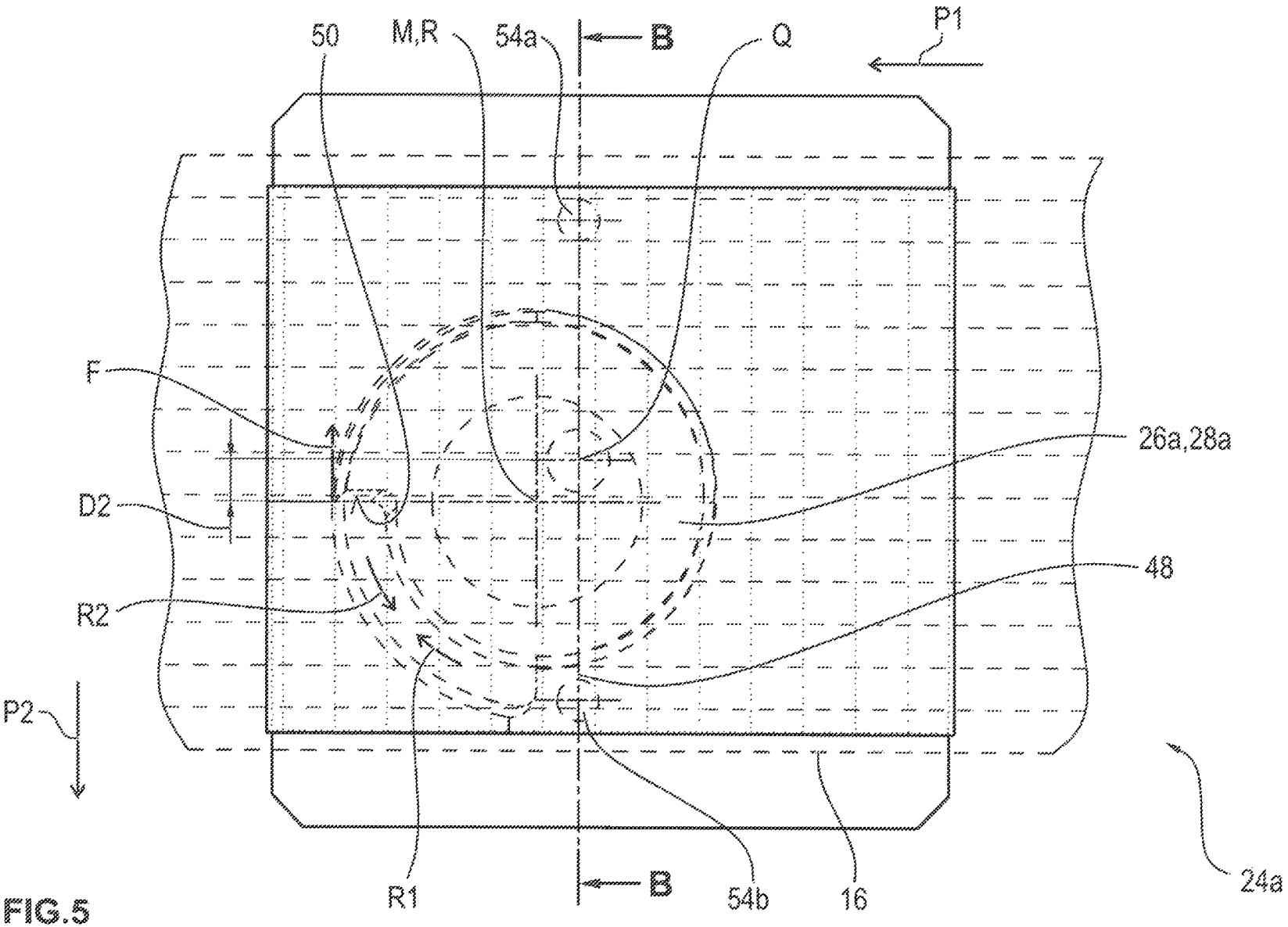
FIG. 5 shows a schematic bottom view of a machining element of the apparatus shown in FIG. 1 with the second connecting element.

FIG. 5 shows a schematic bottom view of a machining element 14*a* of the apparatus 10 with the second connecting element 24*a* shown in FIG. 1. The cross-sectional view shown in FIG. 4*b* corresponds to a sectional view along the cutting line B-B in FIG. 5. In the bottom view of FIG. 5 the section of the belt 16 arranged above the second connecting element 24*a* is shown by means of straight dashed lines. By means of the dotted lines extending perpendicular thereto, the main body 20*a* is indicated. Moreover, in FIG. 5 the connection area 28*a* in the second connecting element 24*a* as well as the rotary body 26*a* received by the connection area 28*a* are indicated by curved dashed lines. The grinding direction P1 is parallel to the longitudinal extension of the belt 16. Further, the feed direction P2 is parallel to the transverse extension of the belt 16. As shown in FIG. 5, the rotary body 26*a* is rotatable in a first rotary direction R1 and in a second rotary direction R2 opposed to the first rotary direction R1. Preferably the rotary body 26 can be screwed tight in the first rotary direction, which is also denoted as tightening direction. With reference to FIG. 5 the first rotary direction R1 corresponds to a negative rotary direction while the second rotary direction R2 corresponds to a positive rotary direction In FIG. 5 in particular the rotary axis R of the rotary body 26*a* displaced by the distance D2 in the grinding direction P1 or in the feed direction P2, respectively, is shown. Preferably this distance D2 measures 4 mm.

The position of the rotary body 26*a* shown in FIG. 5 corresponds to the connected state of the rotary body 26*a*, i.e. the state in which it has been screwed tight. The connected state of the rotary body 26*a* is obtained by rotation of the rotary body 26*a* in the first rotary direction R1. Further, the rotary body 26*a* leaves its connected state when the rotary body 26*a* is rotated in the second rotary direction R2. Thus by a rotation of the rotary body 26*a* in the first or second directions R1, R2 the rotary body 26*a* can be connected to the connection area 28*a* or separated from it. In either case the rotation is carried out manually.

When the rotary body 26*a* is in the connected state, the torque M resulting from the grinding process prevents the rotary body 26*a* from leaving its connected state. The torque M shown in FIG. 5 herein corresponds to a rotary effect on the rotary body 26*a* in the first rotary direction R1. Furthermore, the torque M is caused during the grinding process by forces acting at an angle or transversely to the grinding direction P1 on the surface of the main body 20*a*. These forces are transferred via the main body 20*a* onto the rotary body 26*a*. The asymmetrical arrangement of the rotary body 26*a* described by means of FIGS. 4*a*, 4*b* and 5, results in a resulting force F on the rotary body 26*a*. The resulting force F shown in FIG. 5 acts on the edge 50 of the rotary body 26*a* and provides the torque M. According to the force effect shown in FIG. 5, the vector of the torque M is perpendicular to the surface of the belt 16 and extends into the drawing plane of FIG. 5. Moreover the vector of the torque M shown in FIG. 5 lies on the rotary axis R of the rotary body 26*a*. Thus the connected state of the rotary body 26*a* can be maintained solely by means of the grinding process and the asymmetrical arrangement of the rotary body 26*a*.

Figure 6:
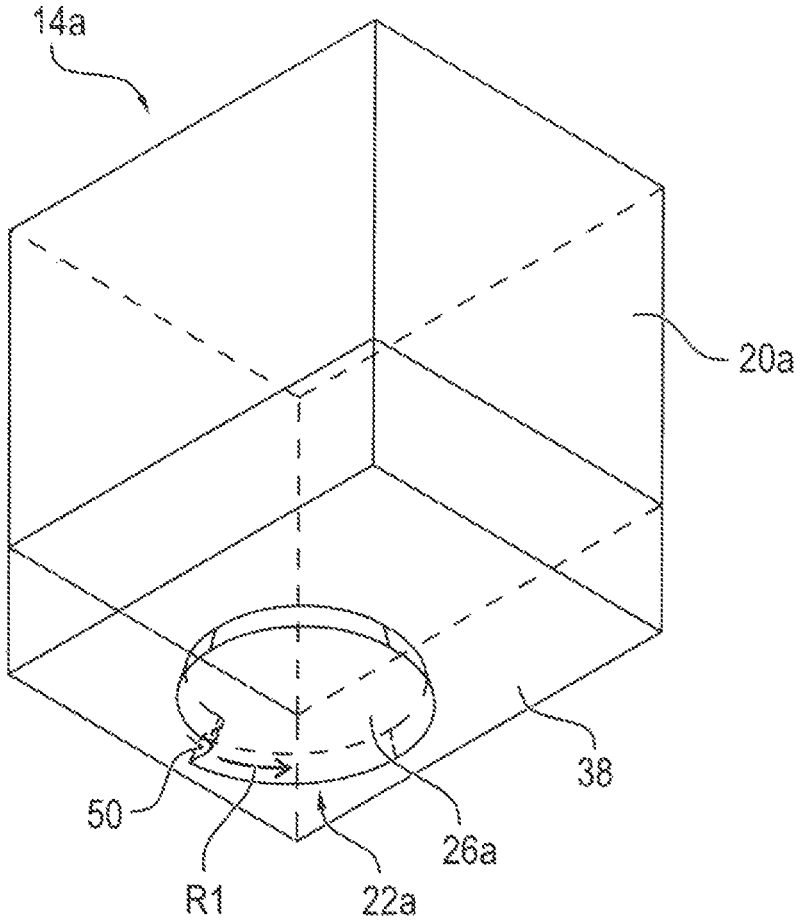
FIG. 6 shows a schematic perspective view of the machining element shown in FIGS. 4*a* and 4*b*, respectively, depicting the contours of the rotary body.

FIG. 6 shows a schematic perspective view of the machining elements 14*a* shown in FIGS. 4*a* and 4*b*, respectively, depicting the contours of the rotary body 26*a*. As shown in FIG. 6*a*, the rotary body 26*a* is arranged on the bottom side 38 of the main body 20*a*. In particular, the rotary body 26*a* and the main body 20*a* are formed together as one piece. Moreover, the helical contours of the rotary body 26*a* are clearly shown in FIG. 6. The rotary body 26*a* shown in FIG. 6 has a side wall which is inclined relative to the bottom side 38 of the main body 20*a*. The corresponding the angle of inclination is smaller than 90°. In FIG. 6 this angle of inclination is not depicted.

Figure 7:
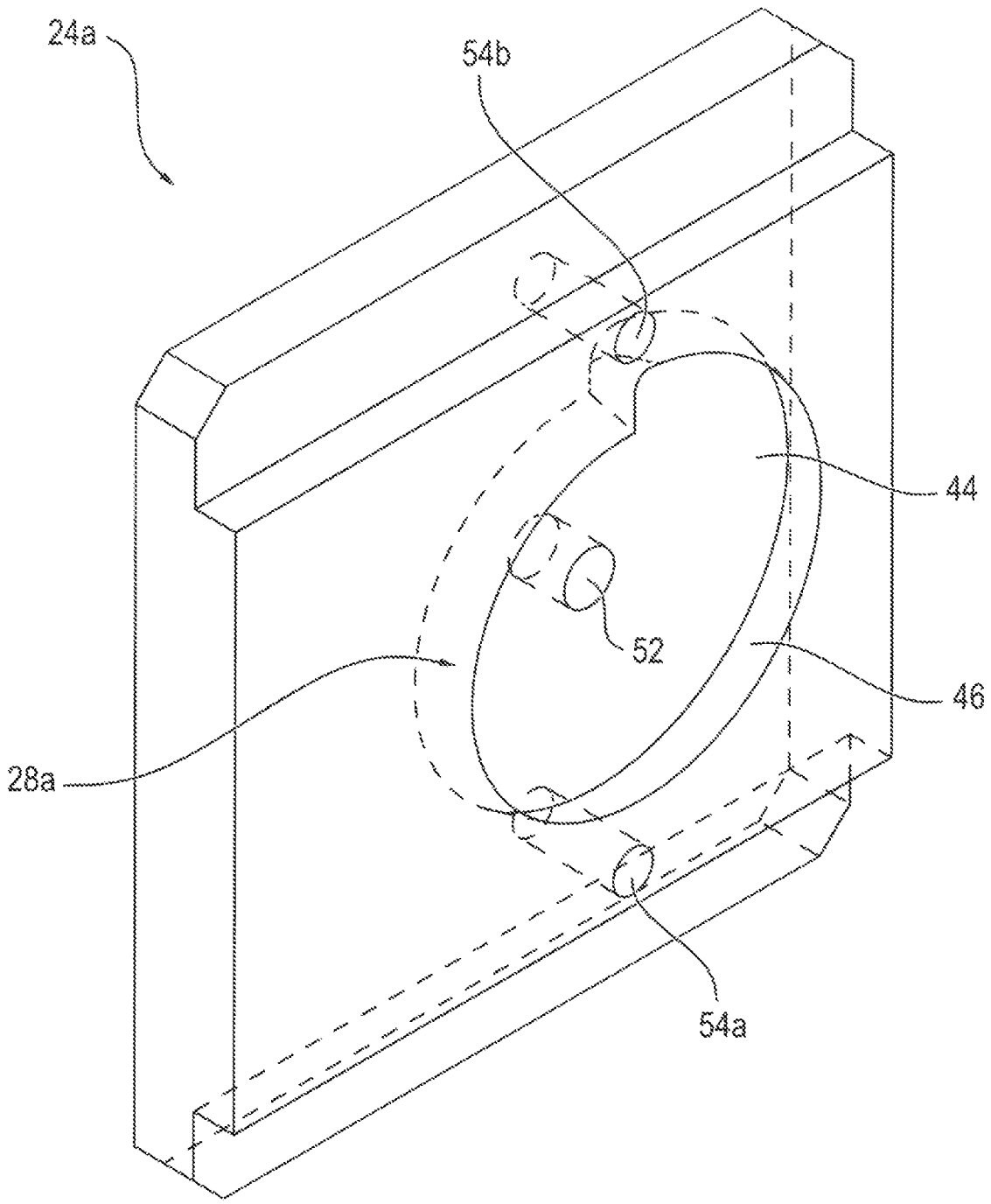
FIG. 7 shows a schematic perspective view of the second connecting element shown in FIGS. 4*a* and 4*b*, respectively, depicting the connection area.

FIG. 7 shows a schematic perspective view of the second connecting element 24*a* shown in FIGS. 4*a* and 4*b*, respectively, depicting the connection area 28*a*. The connection area 28*a* shown in FIG. 7 serves for connecting this area to the rotary body 26*a* having the helical contours as shown in FIG. 6. As depicted in FIG. 7 the connection area 28*a* is formed by means of a recess 44 in the second connecting element 24*a*. The side wall 46 of the recess 44 is inclined in the direction towards the inside of the recess 44. Moreover, FIG. 7 shows that the second connecting element 24*a* has a through bore 52 in the center area of the second connecting element 24*a* and two through bores 54*a*, 54*b* in the peripheral area on opposing sides of the connection area 28*a* of the second connecting element 24*a*. The through bore 52 serves to receive the screw 30*a* shown in FIGS. 4*a* and 4*b* while the through bores 54*a*, 54*b* serve to receive the studs 36*a*, 36*b* shown in FIG. 4*b*.

Figure 8:
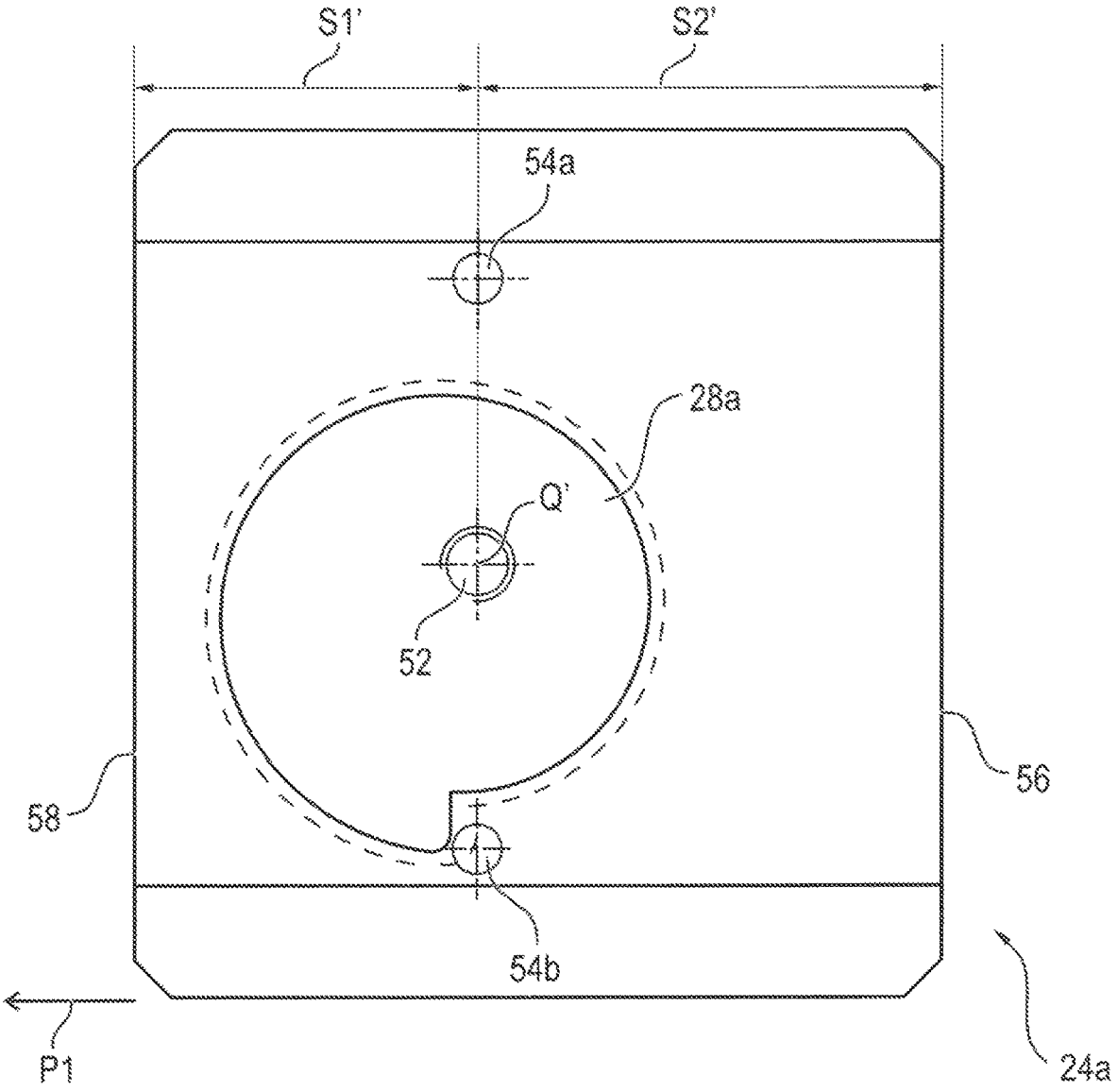
FIG. 8 shows a schematic bottom view of the second connecting element shown in FIG. 7.

FIG. 8 shows a schematic bottom view of the second connecting element 24*a* shown in FIG. 7. In FIG. 8 the arrangement of the through bores 52 and 54*a*, 54*b* is clearly shown. Further, in FIG. 8 the arrangement of the connection area 28*a* relative to the surface of the second connecting element 24*a* is depicted schematically. The center axis Q of the through bore 52 is located at a distance S1' from the front edge 58 of the second connecting element 24 with respect to the grinding direction P1, while the center axis Q' of the through bore 52 is located at a distance S2' from the rear edge 56 of the second connecting element 24*a* with respect to the grinding direction P1. Moreover the connection area 28*a* shown in FIG. 8 is complementary to the rotary body 26*a*. Thus the connection area 28*a* and the rotary body 26*a* can be securely connected to each other.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. An apparatus for machining a workpiece, with at least two machining elements, with a rotating belt for moving the machining elements relative to a workpiece to be machined;

wherein the machining elements each comprise a main body and a first connecting element connected to the main body, which the first connecting element is connectable to a second connecting element which is complementary to the first connecting element and which the second connecting element is connected to the belt on a longitudinal axis Q, wherein the first connecting element comprises a rotary body rotatable about a rotatable axis R perpendicular to the belt, and the second connecting element comprises a connection area for connection with the rotary body, the rotatable axis R being asymmetrically arranged relative to the longitudinal axis Q, wherein when the rotary body is rotated in a first rotary direction (R1) a connected state of the rotary body with the connection area is established, wherein the rotary body leaves the connected state and is separated from the connection area when the rotary body is rotated in a second rotary direction (R2) opposed to the first rotary direction (R1), and wherein when a workpiece is machined by the machining elements as the rotating belt moves, the rotatable axis R being asymmetrically arranged relative to the longitudinal axis Q causes a torque on the rotary body that presents the rotary body from leaving the connected state.

2. The apparatus according to claim 1, wherein the rotary body and the main body are formed together as one piece.

3. The apparatus according to claim 2, further comprising a transport device for generating a relative movement between the workpiece to be machined and the machining elements.

4. The apparatus according to claim 1, wherein the rotatable axis R is arranged asymmetrically relative to a longitudinal side of the main body and/or relative to a transverse side of the main body on the bottom side of the main body facing the second connecting element.

5. The apparatus according to claim 4, wherein a first distance (L1) between the rotary body and a front edge of the main body with respect to the grinding direction (P1) is smaller than a second distance (L2) between the rotary body and a rear edge of the main body with respect to the grinding direction (P1), and that a third distance (L3) between the rotary body and the front edge of the main body with respect to the feed direction (P2) is smaller than a fourth distance (L4) between the rotary body and the rear edge with respect to the feed direction.

6. The apparatus according to claim 5, wherein the connection area is formed by a recess in the second connecting element.

7. The apparatus according to claim 4, wherein the connection area is formed by a recess in the second connecting element.

8. The apparatus according to claim 1, wherein the connection area is formed by a recess in the second connecting element.

9. The apparatus according to claim 8, wherein the side wall of the recess is inclined in a direction towards the inside of the recess.

10. The apparatus according to claim 1, further comprising a transport for generating a relative movement between the workpiece to be machined and the machining elements.

11. The apparatus according to claim 10, wherein the belt is formed such that the machining elements are moved in the area of the workpiece to be machined in a first translatory direction of movement (P1), that the transport device is designed such that the workpiece is moved in a second translatory direction of movement (P2), and that an angle between the first translator direction of movement (P1) and the second translatory direction of movement (P2) is different to 0° and 180°.

12. The apparatus according to claim 1, wherein the second connecting element and the belt are connected to each other in the central area of the belt by means of a screw.

13. The apparatus according to claim 12, wherein the second connecting element is mounted in a rotationally fixed manner with regard to the belt by means of two studs and the two studs are arranged in the peripheral area of the belt on two opposite sides of the connection area.

14. The apparatus according to claim 1, wherein the machining elements are arranged in a spaced apart manner in such a way that the main body is freely rotatable about a rotary angle within a rotary angle range of 25° to 120° when the rotary body is rotated in a first rotary direction (R1) or in a second rotary direction (R2), respectively.

15. The apparatus according to claim 1, wherein the first connecting element and the second connecting element are connectable without the aid of screws such that the main body is removable from the second connecting element when the rotary body leaves the connected state.

16. The apparatus according to claim 1, wherein the belt is a V-belt which is turned about two pulleys and guided endlessly.

17. The apparatus according to claim 1, wherein the machining elements each comprise one of a grinding tool, a brushing tool, or a polishing tool.

18. A machining element configured to be mounted to a rotating belt for moving the machining elements relative to a workpiece to be machined comprising: a main body and a first connecting element connected to the main body which the first connecting element is connectable to a second connecting element of the apparatus complementary to the first connecting element, which the second connecting element is adapted to be connected to the rotating belt on a longitudinal axis Q, wherein the first connecting element comprises a rotary body rotatable about a rotatable axis R axis parallel to and asymmetically arranged relative to the longitudinal axis Q, and which is connectable to a connection area of the second connecting element, wherein when the rotary body is rotated in a first rotary direction (R1) a connected state of the rotary body with the connection area is established, wherein when the rotary body is rotated in the second rotary direction (R2) opposed to the first rotary direction (R1) the rotary body leaves the connected state and is separated from the connection area, and wherein when the machining element is mounted to a rotating belt and a workpiece is machined by the machining element as the rotating belt moves, the rotatable axis R being asymmetrically arranged relative to the longitudinal axis Q causes a torque on the rotary body that prevents the rotary body from leaving the connected state.

19. The machining element according to claim 18, wherein the rotary body is arranged asymmetrically relative to a longitudinal side of the main body and/or relative to a transverse side of the main body on the bottom side of the main body facing the second connecting element.

20. The machining element according to claim 18, wherein the connection area is formed by a recess in the second connecting element.

* * * * *